US008989408B2

(12) United States Patent
Kapp et al.

(10) Patent No.: US 8,989,408 B2
(45) Date of Patent: Mar. 24, 2015

(54) METHODS AND SYSTEMS FOR DOWNLOADING EFFECTS TO AN EFFECTS UNIT

(75) Inventors: Josh D. Kapp, Lehi, UT (US); James D. Pennock, Salt Lake City, UT (US); Robin M. Urry, Draper, UT (US); Christopher M. Belcher, Lehi, UT (US); William E. Clements, Salt Lake City, UT (US); Darrell Brent Erickson, West Jordan, UT (US); Craig B. DeVries, Bountiful, UT (US)

(73) Assignee: Harman International Industries, Inc., Northridge, CA (US)

( * ) Notice: Subject to any disclaimer, the term of this patent is extended or adjusted under 35 U.S.C. 154(b) by 231 days.

(21) Appl. No.: 13/352,527

(22) Filed: Jan. 18, 2012

(65) Prior Publication Data

US 2013/0182861 A1 Jul. 18, 2013

(51) Int. Cl.
*G10H 1/00* (2006.01)
*G10H 1/02* (2006.01)

(52) U.S. Cl.
CPC ..... *G10H 1/02* (2013.01); *G10H 1/0091* (2013.01); *G10H 2240/211* (2013.01); *G10H 2240/285* (2013.01); *G10H 2240/305* (2013.01); *G10H 2240/315* (2013.01); *G10H 2240/321* (2013.01)
USPC ..... 381/118; 381/61

(58) Field of Classification Search
CPC ..... G10H 2220/091
USPC ..... 381/118, 61
See application file for complete search history.

(56) References Cited

U.S. PATENT DOCUMENTS

| | | | | |
|---|---|---|---|---|
| 5,848,164 | A | 12/1998 | Levine | |
| 6,380,474 | B2 | 4/2002 | Taruguchi et al. | |
| 6,423,892 | B1 | 7/2002 | Ramaswamy | |
| 7,990,366 | B2 | 8/2011 | Logue | |
| 2002/0005111 | A1 * | 1/2002 | Ludwig | 84/645 |
| 2002/0065568 | A1 | 5/2002 | Silfvast et al. | |
| 2004/0016338 | A1 | 1/2004 | Dobies | |
| 2004/0203415 | A1 * | 10/2004 | Wu | 455/66.1 |
| 2006/0011052 | A1 | 1/2006 | Purchon et al. | |
| 2006/0117105 | A1 | 6/2006 | Lesenne et al. | |
| 2006/0248447 | A1 | 11/2006 | Makkonen | |
| 2007/0234880 | A1 | 10/2007 | Adams et al. | |

(Continued)

FOREIGN PATENT DOCUMENTS

| | | | |
|---|---|---|---|
| GB | 2387015 | A | 10/2003 |
| WO | 2009012533 | A1 | 1/2009 |
| WO | 2010148227 | A1 | 12/2010 |

OTHER PUBLICATIONS

Web Page: YAMAHA Magicstomp; http://www.magicstomp.com/eng_flash/introduction.index.html.

(Continued)

*Primary Examiner* — Alexander Jamal
(74) *Attorney, Agent, or Firm* — Brooks Kushman P.C.

(57) ABSTRACT

Various embodiments relate to a systems and methods for downloading one or more effects to an effects unit. One or more effects may be received. On an effects unit. Audio signals for the one or more effects may be processed based on instructions for processing the audio signals received with the one or more effects. For each subsequent effect received on the effect unit, the processing of the audio signals may be reprogrammed. The one or more effects may be transmitted for output from the effects unit.

16 Claims, 6 Drawing Sheets

(56) References Cited

U.S. PATENT DOCUMENTS

| | | | | |
|---|---|---|---|---|
| 2010/0269670 | A1* | 10/2010 | O'Connor et al. | 84/626 |
| 2010/0281178 | A1* | 11/2010 | Sullivan | 709/231 |
| 2011/0093888 | A1 | 4/2011 | Araki et al. | |
| 2011/0093889 | A1 | 4/2011 | Araki et al. | |
| 2011/0093890 | A1 | 4/2011 | Araki et al. | |
| 2011/0137754 | A1* | 6/2011 | Fernandez | 705/27.1 |
| 2011/0283362 | A1* | 11/2011 | Horneff et al. | 726/26 |
| 2013/0132509 | A1 | 5/2013 | Styles | |

OTHER PUBLICATIONS

Web Page: YAMAHA Magicstomp; http://www.magicstomp.com/eng_flash/features/index.html.
Web Page: YAMAHA Magicstomp; http://www.magicstomp.com/eng-flash/audiodemo/index.html.
http://web.archive.org/web/20111227063052/http://www.tcelectronic.com/toneprint-app., "TonePrint® App for iPhone® and Android™", Dec. 27, 2011, 3 pages.
http://web.archive.org/web/20111111161211/http://www.youtube.com/, "What is TonePrint?—TC Electronic's Tore Mogensen explains", Nov. 11, 2011, 2 pages.
http://web.archive.org/web/201110311040440/http://www.tcelectronic.com/toneprint, "TonePrint—A Total Tone Transfusion", Oct. 31, 2011, 3 pages.
http://web.archive.org/web/201111112094848/http://itunes.apple.com/us/app/toneprint, "TonePrint", Nov. 12, 2011, 4 pages.
http://web.archive.org/web/20110117212409/http://www.tcelectronic.com/toneprint, "TonePrint—A Total Tone Transfusion", Jan. 17, 2011, 2 pages.
http://web.archive.org/web/20111110220514/http://www.tcelectronic.com/toneprint-app, "TonePrint® App for iPhone® and Android™", Nov. 10, 2011, 3 pages.
http://web.archive.org/web/20110116215542/http://www.tcelectronic.com/toneprints.asp, "Featured TonePrints", Jan. 16, 2011, 10 pages.
http://web.archive.org/web/20040811053838/http://www.line6.com.com/modelPacks.faq.html, Aug. 11, 2004, 3 pages.
http://web.archive.org/web/20060424141008/http://www.line6.com/modelPacks/faq.html, "Model Packs Frequently Asked Questions", Apr. 24, 2006, 3 pages.
http://line6.com/modelPacks/, "Features", Mar. 18, 2012, 3 pages.
http://web.archive.org/web/20100612082204/http://line6.com/modelPacks/faq.html, "Model Packs Frequently Asked Questions", Jun. 12, 2010, 2 pages.
Magicstomp, "Using Your Computer to Edit Patches", Sep. 21, 2004, 1 page.
Magicstomp, "Quick Guide", Apr. 20, 2004, 1 pages.
Magicstomp, "Patch Lists", Apr. 20, 2004, 1 page.
http://web.archive.org/web/20090304152830/http://www.magicstomp.com/eng_flash, Features, "Stunning Effects and Powerful Amp Models", Mar. 4, 2009, 1 page.
http://web.archive.org/web/20090304152830/http://www.magicstomp.com/eng_flash, Features, "99 Factory Presets / 99 User Memories", Mar. 4, 2009, 1 page.
http://web.archive.org/web/20090304152830/http://www.magicstomp.com/eng_flash, Features, "Easy to Use", Mar. 4, 2009, 1 page.
http://web.archive.org/web/20090304152830/http://www.magicstomp.com/eng_flash, Features, "Upload New Effects via USB", Mar. 4, 2009, 1 page.
http://web.archive.org/web/20090304152830/http://www.magicstomp.com/eng_flash, Features, "CD-ROM Patch Library", Mar. 4, 2009, 1 page.
http://web.archive.org/web/20090304152830/http://www.magicstomp.com/eng_flash, Features, "Sound Editor for MAGICSTOMP", Mar. 4, 2009, 1 page.
http://web.archive.org/web/20090304152219/http://www.magicstomp.com/eng_flash, "On-line Patch Library", Mar. 4, 2009, 1 page.
Magicstomp, "Patch List", Dec. 12, 2003, 2 pages.
Magicstomp, "Software for Magicstomp—Installation Guide", 2003, Yamaha Corporation, 11 pages.
Magicstomp, "Owner's Manual", Dec. 12, 2003, 30 pages.
Magicstomp, "Sound Editor for Magicstomp—Owner's Manual", 2003, Yamaha Corporation, 25 pages.
Magicstomp, "Effect List", Dec. 12, 2003, 31 pages.
Extended European Search Report for Application No. EP 13151859.9, mailed May 17, 2013, 8 pages.
Office Action for Application No. EP 13151859.9, mailed May 16, 2014, 7 pages.
Office Action for corresponding U.S. Appl. No. 13/875,042, mailed Sep. 25, 2013, 38 pages.
Office Action for corresponding U.S. Appl. No. 13/875,042, mailed Apr. 16, 2014, 44 pages.
European Office Action for corresponding Application No. 13 151 859.9, mailed Oct. 28, 2014, 5 pages.

* cited by examiner

METHODS AND SYSTEMS FOR DOWNLOADING EFFECTS TO AN EFFECTS UNIT

TECHNICAL FIELD

Various embodiments relate to configurable effects units which can receive and store multiple effects. In some embodiments, the sound effects may be downloaded over the Internet.

BACKGROUND

Effects units are devices used by musicians, such as guitarists, to alter the original sound from an instrument. The effects may be infused while the instrument is being played during a performance or may be used to alter a "dry" (i.e., unaltered) track in a recording studio. Popular examples of such effects units include wah pedals, fuzzboxes, and reverb units. Specific units that may house an effect may include amplifiers, stompboxes, table top units, or rackmounts which may contain one or more effects in the unit. Typically, pedals are sold and used as individual units, each unit programmed with a particular effect. Examples include the stompboxes manufactured and sold by HARMAN INTERNATIONAL as DIGITECH. In addition, effects units are available which may have multiple effects that are factory installed on the unit and operate as a single effects unit.

SUMMARY

One aspect is a computer program product, which may be a mobile application on a user device, for downloading effects to an effects unit. The computer program product being embodied on a computer readable medium may comprise instructions for displaying a graphical user interface on a user device. The interface may have graphical interface items to instruct the download of one or more effects from the user device to an effects unit which may be communicating (e.g., through wired or wireless communication) with the user device. Further instructions may include receiving input, via the graphical user interface, to download one or more effects to the user device. The one or more effects may further include instructions (e.g., software code) for reprogramming the processing of audio signals of the one or more effects on the effects unit. Further instructions may include transmitting the one or more effects to the effects unit.

Multiple effects may be downloaded to the effects unit. In this embodiment, one or more first effects may be stored on the effects unit. Further instructions may include receiving instructions, via the graphical user interface, to download one or more second effects to the user device. The one or more second effects may include instructions for processing the audio signals of the second effects. The instructions of the one or more second effects may also include instructions to overwrite the processing instructions of the one or more first effects. The one or more second effects may be transmitted to the effects unit.

In some embodiments, graphical user interface items may be displayed on a user device identifying if one or more effects are stored on the effects unit. A status of the one or more effects stored on the effects unit may be received from the effects unit and displayed on the graphical user interface for determining if one or more effects are stored on the effects unit.

Another aspect is a system for downloading one or more effects to an effects unit. The system may include one or more effects units capable of being at least partly reprogrammed and configured to receive a first effect from a device communicating with the effects unit and store the first effect in memory of the effects unit. The effects unit may be programmed to process audio signals based on the first effect. The programming may be software code stored in memory.

The effects unit may be further configured to receive a second effect from the device. Upon receiving the effect, or soon after, the effects unit may be configured to reprogram the processing of audio signals on the effects unit based on the second effect. The second effect may be stored in memory of the effects unit.

In some embodiment, instructions may be received by the effects unit to reprogram the processing of the audio signals of the second effect. The instructions may be received with the second effect.

The system may further include a cable connected to the device and the effects unit through which the device communicates with the effects unit. The cable may have at least two heads and at least one embedded authentication chip for authenticating the device and the effects unit which may occur simultaneously or near simultaneously.

Another aspect is a system for downloading one or more effects to an effects unit. The system includes one or more effects units that may be configured to receive one or more effects from memory, process audio signals for the one or more effects based on software code for processing the audio signals received with the one or more effects, reprogram the processing of the audio signals based on the software code for processing the audio signals of the one or more effects, and transmit the one or more effects for output from the effects unit. Steps (a)-(d) may occur repeatedly with each effect downloaded to the effects unit.

Further, based on adjusting instructions received on the effect unit for each effect, the effects unit may be further configured to reprogram adjustment controls for adjusting one or more sounds of each effect. Additionally, the one or more effects units may be configured to receive information associating a color with one or more effects and transmit a lighting signal to one or more LED lights on the effects unit based on the color association.

Another aspect is a method for downloading one or more effects to an effects unit. The method may include receiving a first effect from a device communicating with the effects unit. The first effect may have instructions for processing audio signals associated with the first effect. The first effect and the audio signal processing instructions may be stored in memory of the effects unit. A second effect may be received from the device. The second effect may also have instructions for processing audio signals associated with the second effect. The instructions for processing the audio signals associated with the first effect may be reprogrammed based on the instructions for processing audio signals associated with the second effect. The second effect and the instructions for processing audio signals associated with the second effect may be stored in memory of the effects unit. In some embodiments, tuning instructions may be received from the device for the first or second effect stored on the effects unit which may be used to adjust the sound of the first or second effect.

Another aspect is a system for purchasing and downloading effects to an effects unit. The system may include at least one computing device configured to display a library of one or more effects available for download to an effects unit. A selection of one or more effects from the library may be received via the computing device for previewing the effect on the effects unit. The selection may be transmitted from the computer device for previewing the effect on the effects unit for a limited period of time.

The computer device may be further configured to transmit instructions to monitor a time period defining the previewing time limit to determine when the previewing time limit has been reached. The one or more effects may be unusable once the time limit has been reached. When the one or more effects are downloaded for use, the one or more unusable effects may be enabled, for example, when the effect is purchased.

BRIEF DESCRIPTION OF THE DRAWINGS

The figures identified below are illustrative of some embodiments of the invention. The figures are not intended to be limiting of the invention recited in the appended claims. The embodiments, both as to their organization and manner of operation, together with further object and advantages thereof, may best be understood with reference to the following description, taken in connection with the accompanying drawings, in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Additionally, the disclosure and arrangement of the figures is non-limiting. Accordingly, the disclosure and arrangement of the figures may be modified or re-arranged to best fit a particular implementation of the various embodiments of the invention.

An effects unit typically contains a limited set of effects at the musician's disposal. For example, a stompbox will have one or two effects in a single device or pedal. If a different effect or additional effects are desired by the user, additional stompboxes will have to be purchased. A series of stompboxes linked together is called a chain. The purchase of each new stompbox can be expensive and carrying multiple stompboxes to form a chain can be inconvenient.

Further, effects units may not be fully configurable such that the function and "personality" of the unit can be changed. For example, the re-configuration of the effects unit may be limited to changing the parameters of pre-installed effects on the effects unit through software patches, rather than altering the type of effect on the unit.

In essence, a user should be able to purchase a single hardware device (e.g., a stompbox) and download any number of effects to the effects unit.

Figure 1:
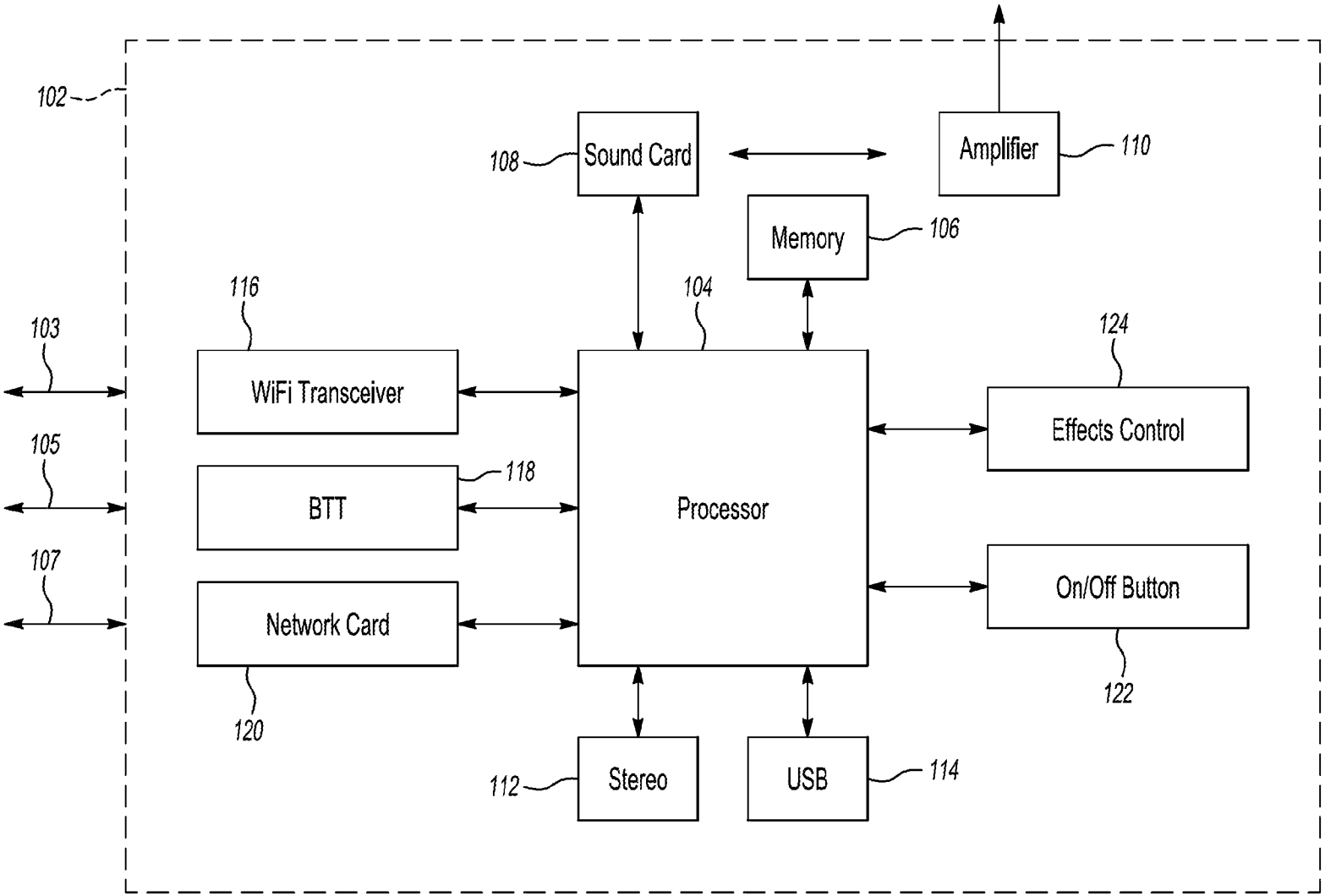
FIG. 1 is a block topology of the architecture of an effects unit.

FIG. 1 illustrates an effects unit to which effects may be downloaded. As used herein, the terms "upload," "uploaded," "uploading," "download," "downloaded," and/or "downloading" describe receiving and/or transmitting effects over a network connection, such as the Internet, and/or from a media storage device such as a USB drive, flash drive, personal computer, CD-ROM, DVD, a personal media player, a mobile phone, and the like. As shown in the figures, the effects unit 102 may be a stompbox or a pedal. However, the effects unit 102 may be any type of effects unit. The various embodiments described may be practiced with any effects unit, but a stompbox is used to describe the various embodiments for purposes of simplicity.

The effects unit 102 has one or more processors 104, such as a digital signal processor (DSP), for processing instructions and commands. Additionally, the effects unit 102 may have persistent and/or non-persistent storage 106 such a hard disk drive and/or memory, such as ROM, RAM, flash memory, or other like memory. The effects unit 102 may have one or more batteries (not shown) for providing power to the effects unit. In some embodiments, the batteries may be rechargeable. Alternatively or additionally, the effects unit 102 may be powered by an electrical connection, such as through a plug-in connection to a wall outlet or a computer.

In some embodiments, the effects unit 102 may have one or more sound cards 108 for transmitting the sound of the effect from the effects unit. The effect unit may be connected to one or more outputs 110, such as, and without limitation, one or more amplifiers, through a wired or wireless connection. Further, the amplifiers(s) may communicate with one or more speakers (not shown) for outputting the sound.

If the output 110 is connected through a wired connection, the output 110 may be connected through the port 112 (e.g., and without limitation, a stereo input) or the USB port 114. In some embodiments, the amplifier(s) may be embedded in the effects unit 102.

If the output 110 is connected through a wireless connection, the output 1111 may communicate with the effects units 102 over WiFi via a WiFi transceiver 116 and/or using a BLUETOOTH connection via the BLUETOOTH transceiver 118. For purposes of clarity, transceiver 116 is described as a WiFi transceiver. However, the transceiver 116 may alternatively be any transceiver capable of communicating using the 802.11 standard. In some embodiments, the effects unit 102 may include one or more inputs for activating wireless connectivity, such as (and without limitation), buttons, switches, knobs, and the like. In other embodiments, the wireless connection may be established automatically. One or more security codes may be required to be input for automatic connection, as may be the case according to a particular implementation of the invention.

While FIG. 1 illustrates a single 802.11 transceiver 116 and BLUETOOTH transceiver 118, there may be multiple transceivers within the effects unit. For example, an 802.11 transceiver and/or a BLUETOOTH transceiver may be used to communicate with the amplifier(s). Additional 802.11 and/or BLUETOOTH transceivers may be used to receive the effects for download over a network connection including, but not limited to, the Internet. It is contemplated that various combinations of wireless transceivers may be utilized. For example, and without limitation, a BLUETOOTH connection may be used for communication with the amplifier(s) and WiFi communication used for downloading the effects. As another non-limiting example, both transceivers could be WiFi transceivers for WiFi communication. As another non-limiting example, the multiple transceivers may be different 802.11 communication standards (e.g., WiFi and WiMax). Of course, there may also be one wireless transceiver that performs multiple functions such as enabling communication with amplifier(s) and download of the effects. In some embodiments, the effects unit 102 may additionally or alternatively have one or more network adapters 120 for wired network communication such as, and without limitation, an Ethernet card or modem card. In some embodiments, the communication may use an Audio-Video Bridging (AVB) network. As shown in FIG. 1, the WiFi transceiver 116, BLUETOOTH transceiver 118, or network card establishes a communication link, 103, 105, 107, respectively, between the effects unit 102 and another device. Further details of the process for downloading effects will be described below.

One or more inputs may be used for activating 122 anchor tuning 124 the effect stored on the effects unit 102. The activation input 122 may be one or more buttons disposed on an outer casing of the effects unit 102 (not shown). In some embodiments, the button(s) may be capacitive, touchscreen, or other like tactile buttons. The effect may be activated when, for example, a user desires to alter the sound from an instrument. When the user desires to revert back to the "dry" sound, the button is pressed again.

The tuning input 124 may be one or more knobs, buttons, switches, or the like controls for tuning the sound of the effect. The tuning input 124 may be disposed on the outer casing of the effect unit 102. Once the effect is received and stored on the effects unit 102, a user may adjust or tune the effects using the tuning input 124 for a customized sound of the effect.

Figure 2:
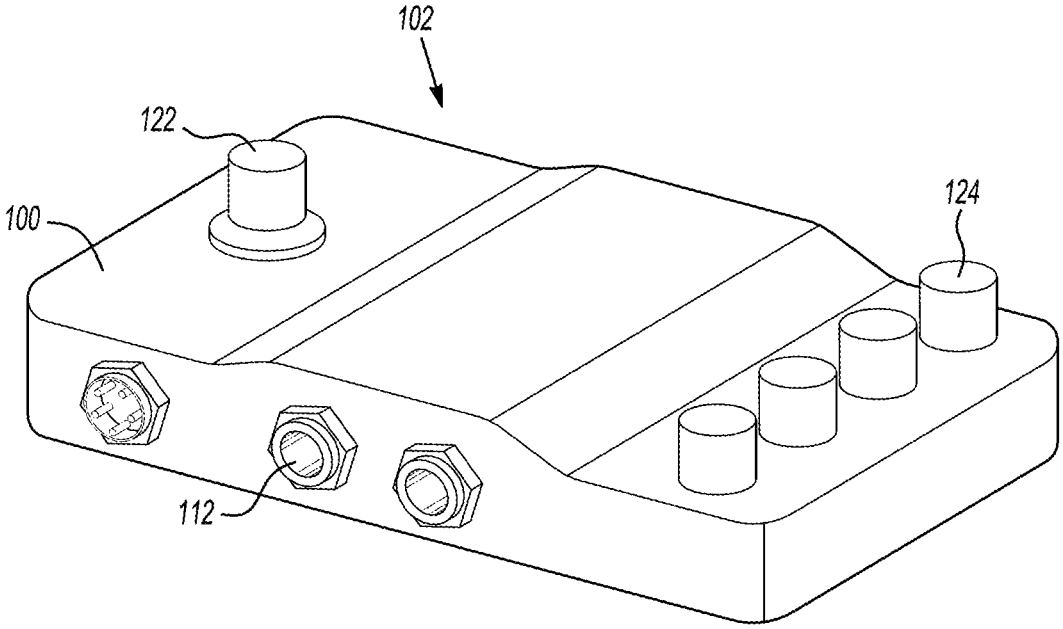
FIG. 2 is an illustration of a type of effects unit such as a stompbox or pedal.

FIG. 2 shows an illustration of the effects unit in the form of a stompbox. As shown, the effects unit 102 has an outer casing 100, multiple tuning inputs 124 extending from the outer casing 100, and an activation input 122. The outer casing 100 may be made of a plastic material. As described above, the tuning inputs 124 and the activation input 122 may be configured differently with respect to type of input, size, location, shape, and the like without departing from the scope of the invention. In the embodiment shown in FIG. 2, the effects unit 102 also includes input jacks 112. As will be described below, at least one input jack 112 may be used as a port for plugging in an instrument, such as a guitar. Additional or alternatively, one or more input jacks may be used to connect peripheral devices, such as amplifiers. Additionally or alternatively, one or more ports may be used for charging the effects unit 102. Additional ports may include, but are not limited to, stereo jacks for input and output, auxiliary jacks, and the like. Although not shown in FIG. 2, the effects unit 102 may additionally or alternatively have one or more USB ports for data transmission, charging, or both. In some embodiments, the effects unit 102 may include one or more ports for proprietary inputs.

When one or more effects are received and stored on the effects unit 102, the effects are transmitted (e.g., through wired or wireless communication) and loaded as software with full configuration (or re-programming) files for the effects unit. The purpose of the effect unit 102 may be re-configured with the download of each effect to the effects unit 102. Further, software updates to the hardware in order to add a new effect to the effects unit 102 is not necessary.

As a non-limiting example, a flanger effect will have a configuration file to configure the effects unit as a flanger effects unit. A reverb effect will have a configuration file to configure the effects unit as a reverb effect. As will be described in further detail below, the configuration of the previously stored effect on the effects unit 102 (e.g., in the non-limiting example above, a flanger effect) may be overwritten by the configuration file of the subsequent effect (e.g., in the non-limiting example above, a reverb effect). By means of this re-programming, a flanger pedal becomes a reverb pedal. Of course, the effects unit 102 may be re-programmed or re-configured with any number of effects and any number of times. Since the effects unit 102 is configured to receive a configuration file for each effect, the effects unit 102 becomes an open-ended configurable system. For example, the effects unit 102 may be re-purposed as future (e.g., currently unavailable or unknown) effects, as well.

The effects unit 102 may not be entirely re-programmed. For example, the bootcode of the effects unit 102 may not be re-programmed. The bootcode may be code that recognizes an effect when downloaded to the effects unit 102.

Each effect may be processed differently by the effects unit 102. As a non-limiting example, the audio signals of each effect may be distinctly processed because each effect is distinct. Based on the configuration files for each distinct effect, the audio signal processing associated with each effect downloaded to the effects unit 102 may be re-programmed. In addition, various controls may be reconfigured such as the tuning/adjustment controls 124.

In some embodiments, the effects unit 102 may display identifying information for the effect on the effects unit 102. As a non-limiting example, the effects unit 102 may display a different LED lighting color for each effect. Further details will be described below.

Figure 3:
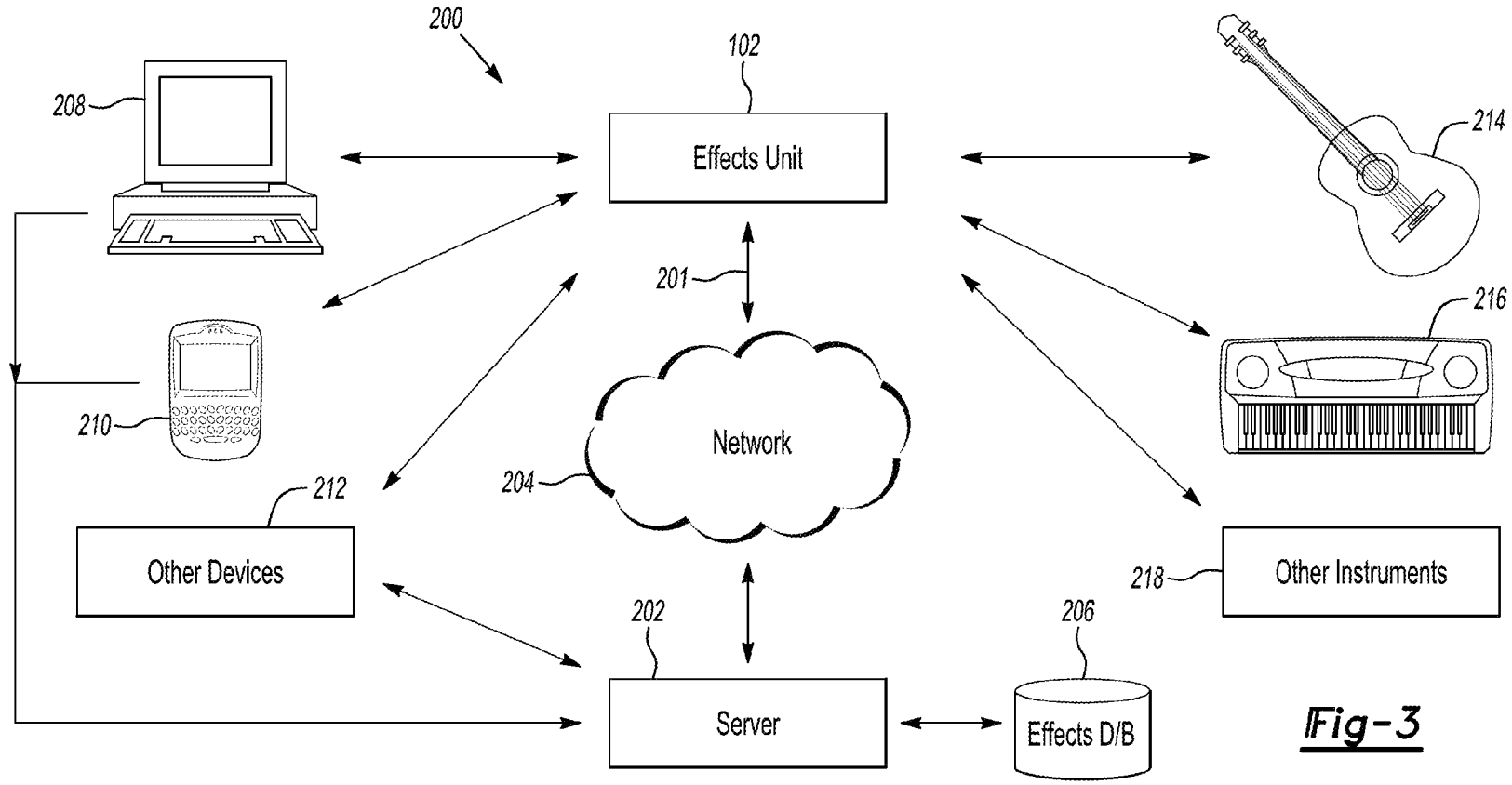
FIG. 3 is an illustration of a system for downloading effects to an effects unit.

Referring now to FIG. 3, a non-limiting example of a system 200 having an effects unit 102 to which new effects and/or services can be received and stored is shown. One or more servers 202 communicating with one or more user devices over a network 204, such as the Internet, may receive requests for and transmit effects to the user devices. The effects may be stored on the server(s) 202, for example in memory, or in one or more databases 206 communicating with the server(s) 202. In the latter case, each effect may be stored as a record in the database 206 having an identifier field, such as (and without limitation) an effect number or an effect name. The effect number may be numeric or alphanumeric. The identifier field may be used when retrieving the effects in response to a user request. In some embodiments, the effect may be associated with an effect number and the effect name may correspond or be mapped to the number. For example, when the user requests the effect from the user device by the effect name, the effect may be queried from the database 206 and retrieved by the unique effect number.

Each record for an effect may include instructions for reconfiguring the effects unit 102 based on the effect and information about the effect which are downloaded to the effects unit 102. Of course, modifications to the organization and arrangement of the data in the database 206 may be made without departing from the scope of the invention. For example, and without limitation, the effect record may include a file path, URL, or the like for accessing the effect data.

In some embodiments, the effects may be downloaded from third-party commercial online retailers. For example, the effects may be downloaded from ITUNES, ANDROID MARKETPLACE, AMAZON.COM, and other like commercial sites. In this case, when connecting to the server(s) 202, the user may communicate with a third-party retailer's server. As will be described in further detail below, software, such as a mobile application, may also be downloaded from such sites to the user device in order to enable downloading of effects to the effects unit 102. In some embodiments, the effects may be downloaded for a fee.

A user, such as a guitarist, keyboardist or other user of an effects unit 102, may download one or more effects through one or more user devices. Non-limiting examples shown in FIG. 3 include one or more computers 208, such as a desktop or laptop, a mobile phone 210, or any other device 212 having a processor, a display, and network connectivity such as, and without limitation, a tablet, a personal media player, a personal digital assistant, or the like. From the user device, a user may establish an Internet connection 204 to the server(s) 202 for downloading one or more effects. Software may be downloaded to the user device for enabling an effects download. For example, and without limitation, a mobile application may be downloaded to the mobile phone 210 or other nomadic device (such as a tablet, PDA, etc.). Software may additionally or alternatively be downloaded to the computer 208. In some embodiments, downloading effects may be possible through a web-based service rather than by using software downloaded to the user device.

The display on user device(s) may display a graphical user interface (GUI). Through the GUI, a user may operate the effects download service including, but not limited to, launching the effects download service, selecting one or more effects to download, displaying the effects owned by the user, displaying a download status of the effects to the user device and/or to the effects unit 102, and other operations. In some embodiments, the display may be a touch-sensitive screen.

Figure 4:
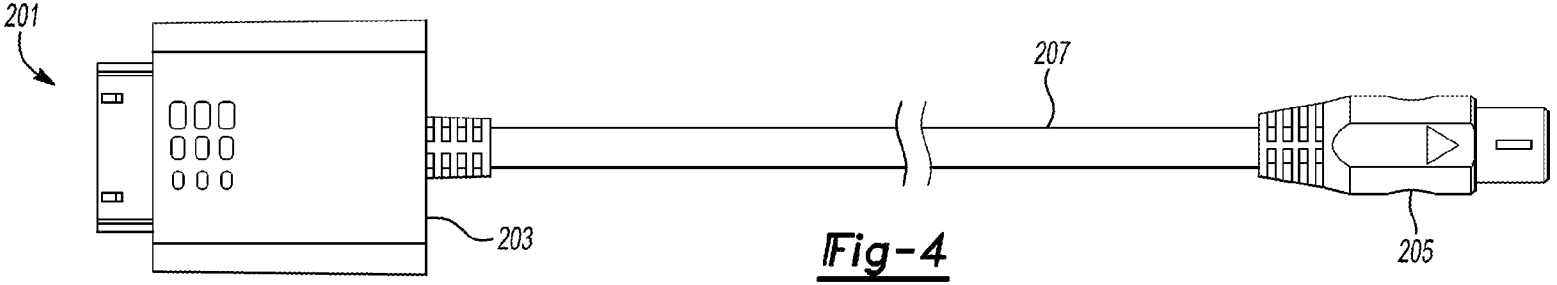
FIG. 4 is an illustration of a cable connecting a user device and an effects unit through which data is exchanged between the user device and the effects unit.

Once downloaded to one or more user devices from the server(s) 202, one or more effects may be transmitted to the effects unit 102 from the user device. The effects downloaded to the user device may be stored in memory of the user device. In some embodiments, the effects may be stored in non-persistent or volatile memory of the user device, such as RAM. The effects may be transferred to the effects unit 102 through a wired or wireless connection. If transferred through a wired connection, the download may be accomplished through a cable connecting the user device and effects unit 102. A non-limiting example of such a connector is illustrated in FIG. 4.

The cable 207 of the connector 201 may have at least one connecting end 203 for connecting to the user device and at least one other connecting end 205 for connecting to the effects unit 102. Connecting end 203 and connecting end 205 may be any type of connector such, and without limitation, a multi-pin connector (e.g., and without limitation, a 30-pin connector), USB, Firewire, TRS connector (e.g., and without limitation, an audio jack), any DIN connector, or any other like connector used for analog and/or digital signal exchange. In some embodiments, the connecting ends may be different connector types. For example, and without limitation, one end may be a multi-pin connector and the other may be an 8 Pin Mini DIN connector. Alternatively, the two ends may be the same type, but different sizes, such as a Standard-A or Standard-B USB plug and a Mini or Micro USB plug.

In some embodiments, at least one connecting end of the cable may include one or more authenticating chips for authenticating the connection between the user device and the effects unit 102. The authentication process may be used to authenticate the devices for security purposes (e.g., validating the user) and/or for financial purposes (e.g., monitoring uses of the effects download mobile app for purposes of collecting royalties or a per use charge). In additional or alternative embodiments, the authentication process may occur wirelessly. Details of the various embodiments of the authentication process are described with respect to FIG. 6.

In some embodiments, the effects may be stored on a portable computer-readable medium, or device, such as a CD, DVD, flash drive, compact flash card, USB stick, external hard drive, a memory stick, or the like. The effects may be stored on the portable device and transferred from the portable device after connecting the device to, or inserting the device into a slot of, the effects unit 102. The effects unit may include one or more slots (not shown) for inserting and reading a memory stick, compact flash card, and the like.

In some embodiments, the effects may be uploaded through a local network connection. For example, the effects may be transferred through a wireless connection as will be described below. Alternatively, the effects may be transferred using a connected network cable, such as an Ethernet cable. Accordingly, the effects unit 102 may have a network cable port (not shown) and network adapter for connecting the network cable and establishing a network connection.

If the effects are uploaded to the effects unit 102 wirelessly, the effects may be transferred using a BLUETOOTH connection, a WiFi connection (or any other 802.11 standard network connection), or other wireless protocol. If transferred using BLUETOOTH, the user device and the effects unit 102 may first be paired. A pairing code may be required to be input from the user device to establish the paired connection. If a WiFi connection, the user may select the effects unit 102 from a menu or list of devices to which the user device can connect over WiFi. Once selected and connected, the transfer to the effects unit 102 may be accomplished. In some embodiments, the wireless connection, whether BLUETOOTH, WiFi, or another wireless communications method, may be established automatically as facilitated by the effects download service (e.g., a mobile application or a web-based service) once the effects download service is launched.

In some embodiments, the effects may be downloaded directly from the server(s) 202 to the effects unit 102. The download may occur through a wired connection (e.g., and without limitation, a phone or Ethernet cable connecting the effects unit 102 to a modem) or wirelessly (e.g., and without limitation, a WiFi connection). The effects unit 102 may communicate 201 with the server(s) over the Internet for downloading the effect(s). The effects unit 102 may include an interface for initiating and controlling the effects download. For example, the interface may be one or more physical inputs, such as buttons, and/or a digital or graphical interface. In some embodiments, the effects unit 102 may only be able to communicate with the server(s) 202. In other embodiments, the effects unit 102 may be able to be used without any restriction (e.g., a user may browse the Web from the effect unit 102). In the latter case, the effects unit 102 may be also configured with a browser for enabling Web browsing.

The digital or graphical interface on the effects unit 102 may also display the status of the download to the effects unit, provide an identification of the effect(s) being downloaded, an identification of the effect being played from the effects unit, the number of effects loaded on the effects unit, and the like. In some embodiments, the digital or graphical interface may be a touch-based user interface having a touch sensitive screen.

With further respect to displaying an identification of the effect loaded on the effects unit 102, the effects unit may additionally or alternatively have one or more LED lights that change color depending on the type of effect loaded on the effects unit 102. Each effect may be associated with a particular identifier for identifying the effect on the effect unit 102, such as a color or design. When an effect is downloaded from the server(s) 202, the download may include a download of the identifier for display as well. For example, if the identifier is a color, the color information will be downloaded to the user device and displayed on the graphical display and/or LED display. As another example, if the identifier is a design, such as one or more letters representing the effect name, the design information will be downloaded and displayed on the graphical display and/or LED display. Additional non-limiting indicators may be a graphic, a name, a symbol, or the like.

In some embodiments, the identifier may be defined by the user according to preferences. For example, the downloadable effect may be programmed with a default color, but the user may change the color according to a preference. The preference may be stored on the server(s) 202 and/or stored locally on the user device. In the latter case, the preferences may be defined before or after downloading the effects from the server(s) 202. The customized effect may be uploaded from the user device to the effects unit 102.

After the effect(s) is downloaded to the effects unit 102, the user may utilize the effect(s) with one or more instruments. As non-limiting examples illustrated in FIG. 3, the instrument may be a guitar 214, a keyboard 216, or any other instrument 218 that may be used with an effects unit 102. Once the effects unit 102 and the instrument are connected, the effects unit 102 may operate and be used like any known effects unit. Additional details of using the effects unit 102 are described below.

Figure 5:
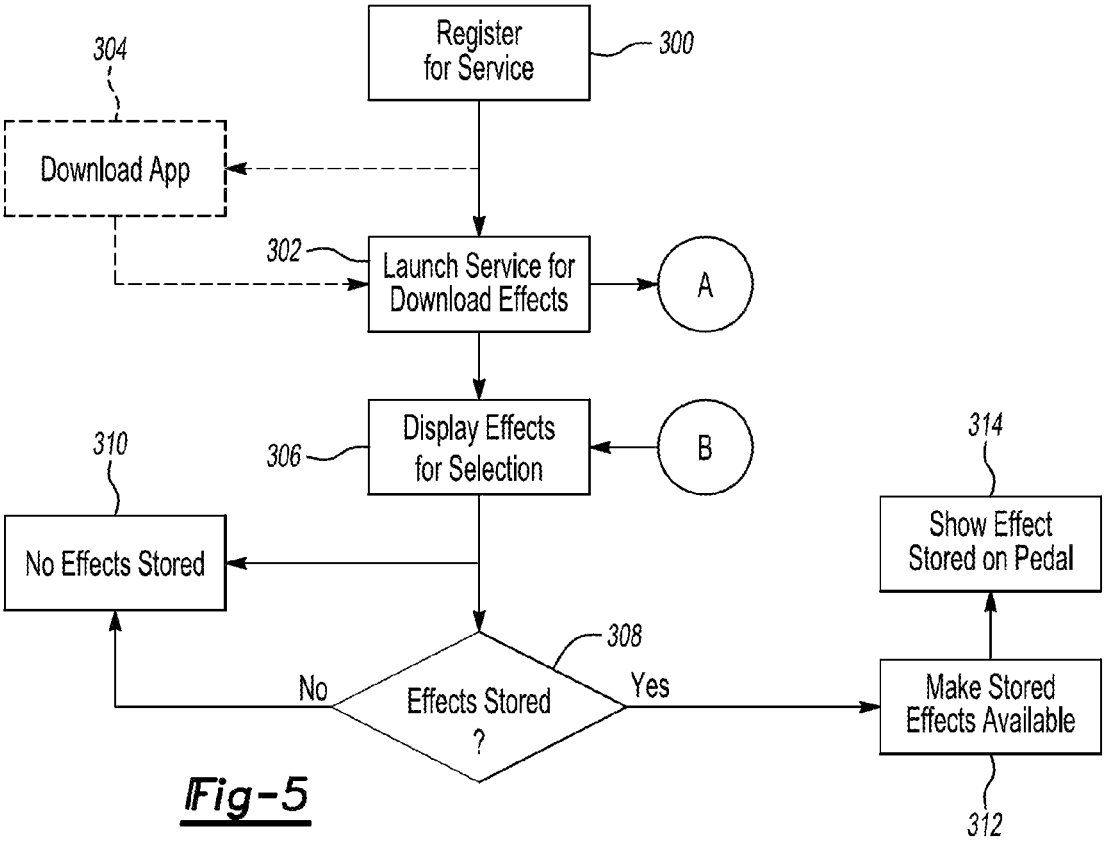
FIG. 5 is a process for searching for and identifying effects for download to an effects unit.

Referring now to FIG. 5, user operation of the effects download service is described and illustrated. FIG. 5 will be described in the context of using the system from a user device. However, the principles of operation may be applied if used from an effects unit 102 as well.

A new user may register for the service by establishing credentials in order to use the service (block 300). The service may be a web-based service and, upon establishing credentials and the user logging on, the service may be launched. The user may or may not have to download software to the user device in order to use the web-based service.

If the new user will use the service through downloadable software, such as a mobile application to a mobile device or application software to a computer, the user may download the software once registered. (block 304). If the software requires some configuration by the user after download, the user may do so from the user device.

Registered users may launch the service from a web browser and/or through downloaded software (block 302). Once launched, the effect(s) available for selection may be displayed on the user device (block 306). The user may select from a number of different effects (as a non-limiting example, in the hundreds) which may be downloaded to the effects unit 102. The user may select one or more effects which will be downloaded to the effects unit 102 as described above. The effects unit 102 may be capable of storing a number of effects (as a non-limiting example, in the hundreds) which may be at the user's disposal. From the multiple effects available, however, the user may only use a single effect at a time.

To select which effect to enable, the user may do so from the effects unit or from the user device. A library of effects may be displayed and the user may select one effect from the library which may be loaded into memory of the device. Once selected from the library, the user may select a button or provide a command to upload the effect to the effects unit 102. To enable additional effects, an effect may be selected from the library and uploaded to the effects unit 102. The new effect may replace the previously loaded effect.

In some embodiments, all of the selected effects from the library and/or all owned effects may be stored in memory of the effects unit 102. In response to a user selection of a stored effect, the selected effect may be retrieved from memory and the effect unit 102 may include instructions for loading and enabling the stored effect. In additional or alternative embodiments, the selected effect may be retrieved from a first memory and transmitted to a second memory for loading and enabling the selected effect. Further details of enabling effect for use with an instrument will be described with respect to FIG. 8.

Registered users may or may not have any effects stored in a library. For example, first time user may not have any effects. Additionally, certain users may have registered and browsed service capabilities (such as previewing effects), but may not own any effects. The effects download service may provide the user the ability to review and access effects that the user owns. For example, and without limitation, the effects may be presented in a library of effects owned by the user (e.g., a "My Effects" or "My Pedals" page) as described above. Of course, the nomenclature used may differ according to the specific implementation of the invention. Referring to block 308, if the user does not have any effects stored, the library may be blank and/or include a notification that no effects have been stored or purchased (block 310).

If at least one effect is stored, the effects that are owned by the user may be presented and made available to the user (block 312). The user may view which effect is currently enabled on the effects unit 102 (block 314). Further details will be described with respect to FIG. 7.

In some embodiments, the user may identify which effects have been uploaded to the effects unit. The identification may be by an indicator, such as graphic associated with the loaded effects, highlighting or some other such indicator. The user may upload the effects which have not yet been uploaded to the effects unit 102. Additionally or alternatively, the user may upload effects to replace previously uploaded effects (e.g., effects that are not working, effects that were erased, or replace the currently loaded/enabled effect).

Figure 6:
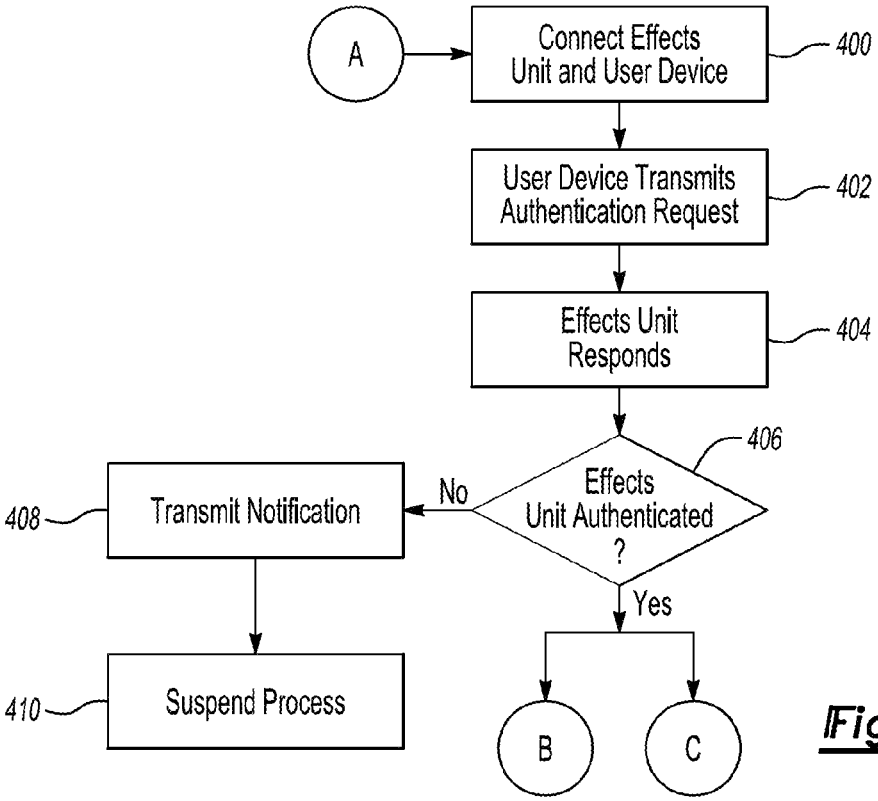
FIG. 6 is one embodiment of the authentication process between a user device and a effects unit.

As shown in FIG. 6 and continuing at circle block A on FIG. 5, when the user connects the effects device 102 to the user device and launches the download service, the devices may first may be authenticated by, for example, at least one authenticating chip in at least one of the connectors or heads of the cable. Additionally or alternatively, the authentication may occur wirelessly. The user device and/or the effects unit 102 may be loaded with authenticating software for accomplishing the authentication once a connection is established between the devices. FIG. 6 illustrates the authentication process for a wired or wireless connection.

As described above and illustrated in block 400, the user device and the effects unit 102 may be connected or a connection established. Once connected, a challenge-response authentication may take place for authenticating the user device and the effects unit 102. In one embodiment, as shown in FIG. 6, the user device may transmit an authentication request to the effects unit 102 (block 402). The effects unit 102 may return a validating response to the user device (block 404). The authentication values exchanged in the request and response may be matching or corresponding numeric, alphanumeric, or graphic codes. If the response from the effects unit 102 is validated, the effects unit 102 is authenticated. The process may continue at circle block B in FIG. 5 or to circle block C in FIG. 8 which will be described in further detail below (block 406). If the effects unit 102 is not authenticated, a notification may be transmitted to the effects unit 102 to notify the user of the status (block 408). Without authentication, the process may be suspended (block 410). In some embodiments, a pre-defined number of attempts may be made before the process is suspended.

In some embodiments, the effects unit 102 and the user device may be independently authenticated by the authentication chip. The authentication may occur simultaneously or near simultaneously. As a non-limiting example, a request for authentication may be exchanged between the authentication chip and the effects unit 102 and the authentication chip and the user device simultaneously or near simultaneously. In alternative embodiments, the authentication of either device may occur conditioned upon the authentication of the other device. In some embodiments, the authentication process may be a challenge-response type of authentication.

As described above, the effects download may be accomplished by the effects unit 102. Thus, the authentication process as described above may alternatively be performed by the effects unit 102.

Figure 7:
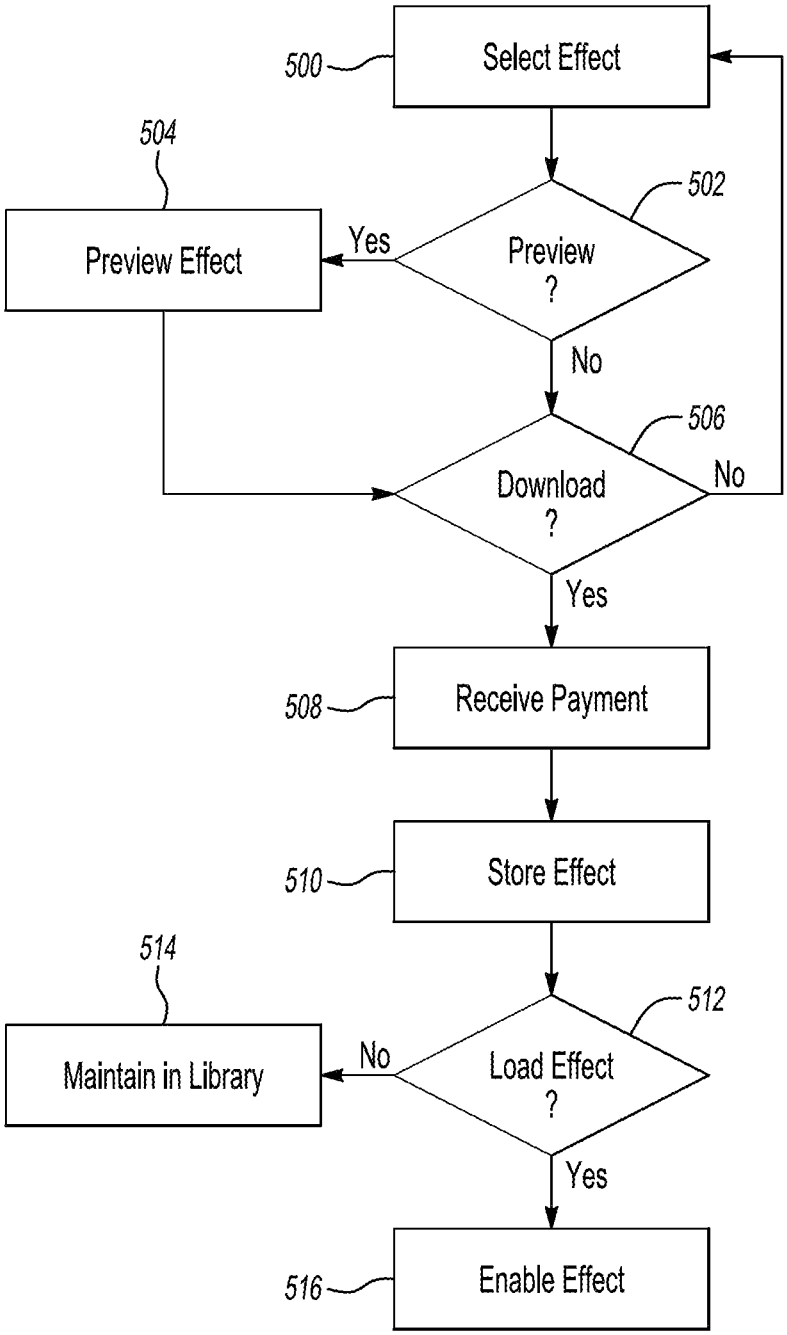
FIG. 7 is one embodiment of the process for purchasing one or more effects for download to an effects unit.

When operating the effects download service, the user may view the effects on the effects unit 102, load effects to the effects unit 102, manage (e.g., add or remove) the effects from the effects unit 102, or perform other like operations with the effects. FIG. 7 shows a non-limiting process for purchasing and downloading one or more new effects to the effects unit 102.

The user may run the effects download service on the user device and an interface, such as a graphical user interface, may be displayed on the user device. The interface may display the effects that are available for download and the effects that the user has already downloaded. The interface may also display new effects and effects that are provided at a discount price. From the library of available effects for download, the user may select an effect to download (block 500).

A user can also preview or sample an effect from the effects interface. The user may select the effect for preview or press a button (e.g., a graphical button) associated with the effect to preview the effect. The preview can be of the effect enabled and/or the effect bypassed. A bypassed sound is one that is unprocessed (e.g., does not use the effect).

Bypassing an effect may also occur when the effects unit 102 is used. The uploaded effect may be bypassed from the effects unit such that the unprocessed sound is heard by the user. To bypass the effect, the user may select a button or switch on the effects unit 102.

In some embodiments, the user may also demo the effect on the effect unit 102. The user may select an option to demo the effect on the effects unit 102 from the user interface of the effect download service. The demoed effect may be downloaded to the effects unit 102 temporarily. The effect may be stored on the effects unit 102 for a predetermined period of time and the demoed effect removed or disabled after the period of time has expired. In some embodiments, the effects unit 102 may enter into bypass mode after the expiration of the time. Software code programmed to the effects unit 102 may include instructions for monitoring the time elapsed during a demo and remove or disable the demoed effect, or cause the effects unit 102 to bypass the effect, once the demo is complete.

When an effect is selected, it may be previewed or demoed by the user (block 502). The effect may be played from the user device or demoed from the effects unit 102 (block 504). The user may or may not download the effect (block 506). If not downloaded, the user may select another effect to download or preview (block 500). If the effect is selected for download, the user may first submit payment information for purchasing the effect. The payment information and payment may be received from the user using a secure payment system (block 508).

In some embodiments, the pricing for an effect may be updated periodically. A pricing update file may be stored on the server(s) 202. Prior to payment processing, a check may be made on the server(s) 202 for a pricing update. The check may be made periodically and before payment of an effect. If the effect pricing is updated, the updated pricing will be received from the server(s) and displayed on the interface. The effect may be purchased with the updated pricing.

If downloading an effect requires payment and payment is received, the effect may be downloaded and stored (block 510). The effect may be stored on the user device or the effects unit 102. Once stored, the effect may be available for the user's use. The user may select the downloaded effect, or any other effect, from the library of effects for loading to the effects unit 102 as described above (block 512). If not selected, the effect is maintained in the library (block 514). Otherwise, the effect may be enabled for use with the effects unit 102 (block 516).

Figure 8:
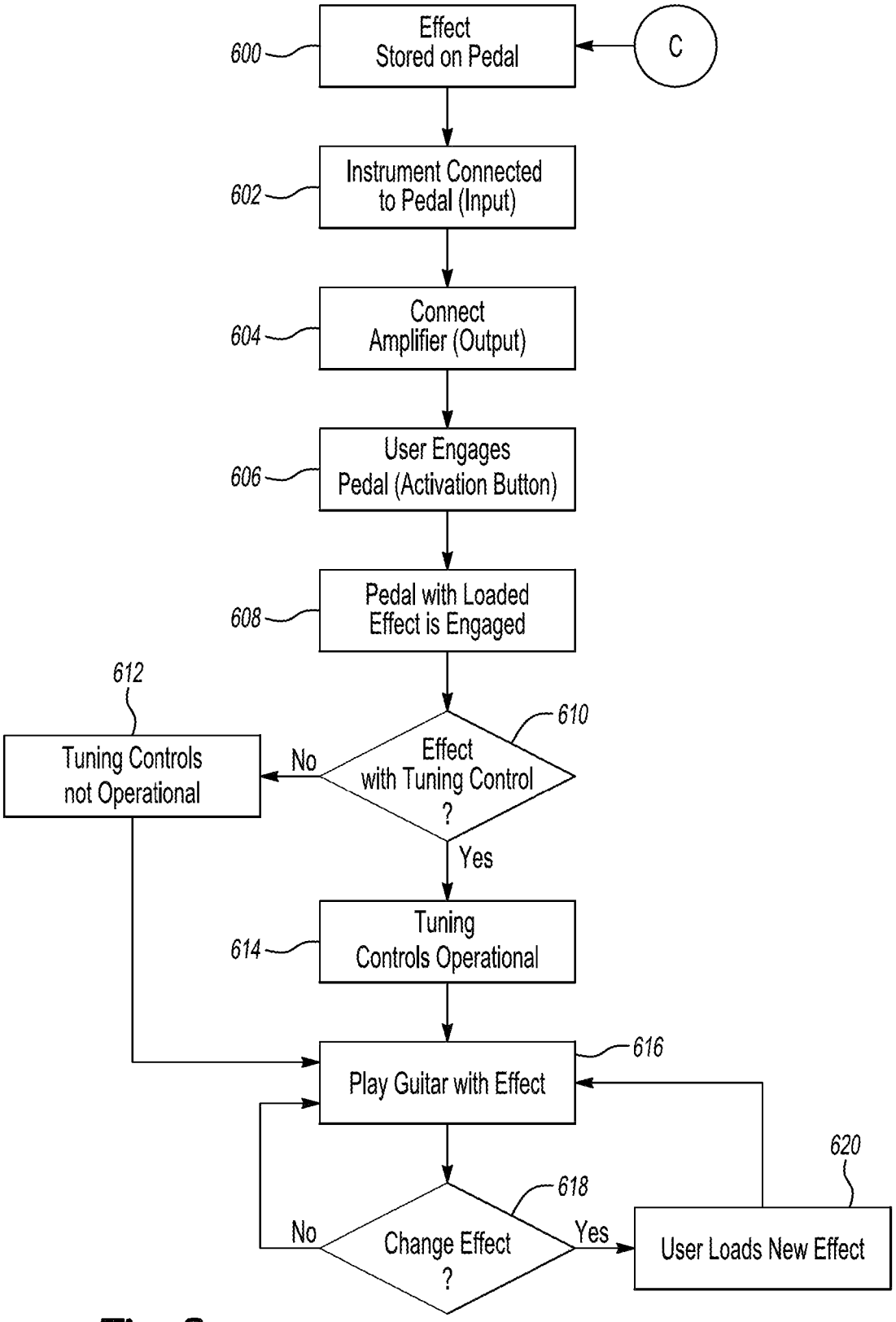
FIG. 8 is a process for using the effect that is downloaded to the effects unit.

FIG. 8 shows an operation for using a downloaded effect with the effect unit 102. Referring back to FIG. 6, the connection between the user device and the effects unit 102 may be authenticated before the effect may be used (represented in FIG. 8 by circle block C). The effect may previously have been loaded on to the effects unit 102 (block 600). One effect may have an entirely different function than another effect loaded on to the effects unit 102. Thus, each of one or more effects that may be used may change the function of the effects unit 102. For example, for a single effects unit 102, such as a stompbox or pedal, the user may have a library of different effects, each of which may change the function or purpose of the stompbox or pedal. Non limiting examples include distortion, revert, chorus, flanger, delay, compressor, and the like.

An instrument may be connected to the effects unit 102 (block 602) which is input to the effect unit 102 for processing the sound with the loaded effect. In some embodiments, the effects unit 102 may be connected to one or more amplifiers for output (block 604).

The user may engage or power the effects unit 102 for enabling an effect (block 606) by pressing a power button or a footswitch on the effects unit 102 for engaging the effects unit 102. Once pressed, the effects unit 102 may be engaged (block 608).

In some embodiments, an effect may include capability to modify or tune the effect sound. For example, and without limitation, the graphical interface on the user device may include one or more graphical input controls for tuning the effect. For example, the graphical input control may be one or more knobs corresponding to the knobs on the effects unit 102. In some embodiments, only some effects may have the capability of being tuned.

In some embodiments, the tuning controls may be mapped to the tuning controls 124 on the effects unit 102. For example, a tuning change of the effect from the tuning controls on the effects unit 102 may show on the graphical interface.

In some embodiments, additional tuning on the interface may be available that is not available from the limited number of tuning control on the physical effect unit 102. For example, the effects unit 102 may include instructions for additional tuning which can be read and operated on by the user device. Additionally or alternatively, software code representing the additional tuning can be transmitted to the effects unit 102 with the download of the effect to the effect unit 102. The processor on the effects unit 102 can receive the software code and process it for use as a tuning control. As a non-limiting example, the physical effects unit 102 may have 4 tuning control 124 (as shown in FIG. 2), but the configuration file associated with the downloaded effect may configure the effects unit 102 to recognize and receive tuning/adjustment instructions for a fifth tuning control. In this case, the tuning/adjustment may occur from the graphical user interface on the user device.

If the downloaded effect has tuning capability, the tuning controls may be operational when using the effects unit 102 (block 614). Otherwise, the tuning controls may not be operational (block 612). In either case, the instrument may be played with the effect enabled (block 616).

The user may change the effect that is currently loaded on the effects unit 102 (block 618) for a different sound. The change may be a different processed sound (e.g., a different effect) or may be instructions to bypass the effect (e.g., using an unprocessed or "dry" sound). Tthe change in a processed sound may entirely change the function of the effects unit 102.

If the effect is not changed, the instrument may be played with the currently loaded effect (block 616). Otherwise, another effect may be loaded to the effects unit 102 as described above with respect to FIG. 7 (block 620). The user may play the instrument with the new effect (block 616).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for downloading one or more effects to an effects unit, the system comprising:

one or more effects units capable of being at least partly reprogrammed upon receiving one or more effects and configured to:

receive a first effect from a user device communicating with the effects unit;

process audio signals based on the first effect;

store the first effect in memory of the effects unit;

receive a second effect from the user device;

reprogram the processing of audio signals on the effects unit based on the second effect; and store the second effect in memory of the effects unit; and a cable connected to the user device and the effects unit through which the user device communicates with the effects unit, wherein the cable includes at least two heads and at least one embedded authentication chip for authenticating the user device and the effects unit.

2. The system of claim 1 wherein the one or more effects units are further configured to receive instructions to reprogram the processing of audio signals of the second effect.

3. The system of claim 1 wherein the authentication of the user device and the authentication of the effects unit occur simultaneously or near simultaneously.

4. The system of claim 1 wherein the user device is a nomadic device.

5. The system of claim 1 wherein the effects unit is further configured to transmit status information to the user device identifying the effect stored on the effects unit.

6. The system of claim 5 wherein the status information is displayed on the user device.

7. The system of claim 1 wherein the user device is configured to store code for processing the audio signals of the first effect in memory.

8. A system for purchasing and downloading effects to an effects unit, the system comprising:

at least one computing device configured to:

display a library of one or more effects available for download to an effects unit;

receive a selection of one or more effects from the library for previewing the effect on the effects unit;

transmit the selected one or more effects for previewing on the effects unit, wherein previewing the one or more effects includes a previewing time limit;

transmit instructions to monitor a time period defining the previewing time limit to determine when the previewing time limit has been reached;

transmit instructions for making one or more effects unusable once the time limit has been reached;

transmit instructions to enable the one or more unusable effects when the one or more effects are downloaded for use; and receive a selection of a first effect for previewing a first effect and a selection of a second effect for previewing a second effect on the effect unit, wherein when the second effect is selected, the second effect is transmitted with instructions to overwrite processing instructions for the first effect on the effects unit with processing instructions for the second effect.

9. The system of claim 8 wherein the instructions to enable the one or more unusable effects are transmitted when the one or more effects are purchased.

10. The system of claim 8 wherein the instructions to make one or more effects unusable once the previewing time limit has been reached are instructions to remove the previewed effect from memory.

11. The system of claim 8 wherein the effects unit includes a bypass mode, the instructions to make one or more effects unusable are instructions to activate bypass mode.

12. The system of claim 8 wherein the instructions to enable the one or more effects are instructions to deactivate bypass mode.

13. An apparatus for purchasing and downloading musical effects, the apparatus comprising:

an effects unit configured to:

receive a signal from a user device that provides one or more effects available for download to the effects unit, the signal providing a selection to preview the one or more effects on the effects unit within a previewing time limit;

monitor a time period defining the previewing time limit to determine when the previewing time limit has been reached;

make the one or more effects unusable once the previewing time limit has been reached; and receive a first indication from the user device of a first effect for previewing the first effect on the effects unit and a second indication from the user device of a second effect for previewing the second effect on the effects unit, wherein when the second effect is received, the second effect is received with instructions to overwrite processing instructions for the first effect on the effects unit with processing instructions for the second effect.

14. The apparatus of claim 13 wherein the effects unit includes a transceiver to wirelessly receive the signal from the user device.

15. The apparatus of claim 13 wherein the effects unit includes a bypass mode and wherein the effects units is further configured to execute the bypass mode when making the one or more effects unusable.

16. The apparatus of claim 13 wherein the effects unit is further configured to make the one or more effects unusable on the effects unit once the previewing time limit has been reached by removing the one or more effects that are unusable from memory of the effects unit.

* * * * *